US006655366B2

(12) United States Patent
Sakai

(10) Patent No.: US 6,655,366 B2
(45) Date of Patent: Dec. 2, 2003

(54) VAPOR SEPARATOR IN OUTBOARD MACHINE

(75) Inventor: Makoto Sakai, Kawasaki (JP)

(73) Assignee: Keihin Corporation, Tokyo (JP)

( * ) Notice: Subject to any disclaimer, the term of this patent is extended or adjusted under 35 U.S.C. 154(b) by 75 days.

(21) Appl. No.: 10/058,980

(22) Filed: Jan. 28, 2002

(65) Prior Publication Data

US 2002/0100457 A1 Aug. 1, 2002

(30) Foreign Application Priority Data

Jan. 30, 2001 (JP) ..... 2001-022200

(51) Int. Cl.[7] ..... F02M 33/02

(52) U.S. Cl. ..... 123/518; 123/509

(58) Field of Search ..... 123/509, 461, 123/518, 516; 417/423.3; 210/416.1, 416.4; 418/225

(56) References Cited

U.S. PATENT DOCUMENTS 5,103,793 A * 4/1992 Riese et al. ..... 123/516
5,389,245 A * 2/1995 Jaeger et al. ..... 210/129
5,855,197 A * 1/1999 Kato ..... 123/516

* cited by examiner

*Primary Examiner*—Mahmoud Gimie
(74) *Attorney, Agent, or Firm*—Zito tlp; Joseph J. Zito; Kendal M. Sheets

(57) ABSTRACT

A vapor separator in an outboard machine which can continuously inject an accurate and stable fuel toward an intake pipe without drawing bubbles discharged from a pump chamber in a high pressure fuel pump and bubbles within the vapor separator by the high pressure fuel pump. The separator is structured such that a filter (2) is arranged in a bottom portion (1A) of a fuel pump receiving case (1), an upstream chamber (10) of the filter (2) is connected to a vapor separator (V) via a fuel inflow passage (1C), a fuel inflow passage (PA) of a high pressure fuel pump (PH) received and arranged within the fuel pump receiving case (1) is connected to a downstream chamber (5) of the filter (2). A vapor discharge chamber (9) is formed so as to face to a bottom portion (PF) of the high pressure fuel pump (PH).

3 Claims, 4 Drawing Sheets

PRIOR ART

PRIOR ART

VAPOR SEPARATOR IN OUTBOARD MACHINE

CROSS REFERENCE TO RELATED APPLICATIONS

This application claims priority of Japanese Patent Application No. 2001-022200 filed on Jan. 30, 2001.

BACKGROUND OF THE INVENTION

1. Field of the Invention

The present invention relates to a fuel injection apparatus for an outboard machine in which a fuel within a fuel tank arranged at a position apart from an engine is supplied into a vapor separator by increasing a pressure to a low pressure by means of a low pressure fuel pump, the fuel is controlled to form a fixed liquid surface within the vapor separator by a fixed liquid surface control mechanism so as to be separated into vapor and liquid, a pressure of the fuel within the vapor separator is increased to a high pressure by a high pressure fuel pump so that the fuel is supplied toward a fuel injection valve attached to a fuel distributing pipe, and a high pressure fuel is injected and supplied into an intake pipe connected to the engine via the fuel injection valve controlled by an ECU, and in particular, relates to a vapor separator provided with a high pressure fuel pump.

2. Description of the Conventional Art

The conventional vapor separator provided with the high pressure fuel pump is shown in Japanese Unexamined Patent Publication No. 8-312485. A description will be given with reference to FIG. 3 (corresponding to a structure shown in FIGS. 22 and 23 in Japanese Unexamined Patent Publication No. 8-312485). Reference symbol V denotes a vapor separator, within which a fixed liquid surface control mechanism F is arranged. The fixed liquid surface control mechanism F is constituted of a valve seat 21 connected to a low pressure fuel flow passage 20, a float valve 22 opening and closing the valve seat 21 and a float 25 rotatably supported by a shaft 23 and in which an arm 24 is arranged so as to face to and contact with the float valve 22. In a low liquid surface state in which a fixed liquid surface X-X having a fixed height is not formed within the vapor separator V, the float 25 rotates in a counterclockwise direction, the float valve 22 opens the valve seat 21 and a low pressure fuel is supplied into the vapor separator V from the low pressure fuel flow passage 20. On the other hand, in a state in which the fixed liquid surface X-X is formed within the vapor separator V, the float 25 rotates in a clockwise direction, and the float valve 22 closes the valve seat 21 so as to stop the fuel supply from the low pressure fuel flow passage 20 into the vapor separator V, thereby forming and holding the fixed liquid surface X-X within the vapor separator V. As a high pressure fuel pump PH, a wesco type pump is used. A fuel suction passage PA of the high pressure fuel pump PH is inserted and arranged within a second fuel storage 26 separated from the vapor separator V via a filter 27. The second fuel storage 26 is held to be airtight by a seal ring 28 arranged in an upper portion thereof, and a lower portion thereof is communicated with the fixed liquid surface X-X of the vapor separator V by a communication passage 29. The vapor separator V provided with the high pressure fuel pump PH mentioned above is structured by respective elements being connected as shown in FIG. 2 and the fuel injection apparatus of the outboard machine is thereby formed. A description will be given with reference to FIG. 2. Reference symbol T denotes a fuel tank arranged at a position apart from the engine, the pressure of the fuel within the fuel tank T is increased to a low pressure by a low pressure fuel pump PC such as a diaphragm pump or the like, and the fuel having the low pressure is supplied toward the valve seat 21 of the vapor separator V via the low pressure fuel flow passage 20. The low pressure fuel is supplied into the vapor separator V via the valve seat 21, and a fixed liquid surface X-X is formed and held in the inner portion by the fixed liquid surface control mechanism F. The fuel stored within the vapor separator V is supplied into the second fuel storage 26 via the communication passage 29, the fuel stored within the second fuel storage 26 is sucked into the high pressure fuel pump PH via the filter 27 and the fuel suction passage PA, the pressure thereof is increased to a high pressure in the pump portion, and the fuel having the high pressure is supplied into a fuel distribution pipe D via a fuel discharge passage PB and a high pressure fuel flow passage 30. A part of the high pressure fuel supplied into the fuel distribution pipe D is circulated into the vapor separator V via a return fuel passage 31, and a fuel pressure within the fuel distribution pipe D is controlled to a predetermined fixed fuel pressure in accordance with a regulating effect of a pressure regulator R arranged within the return fuel passage 31. Further, the fuel having the predetermined pressure is injected and supplied into an intake pipe K connected to the engine E via the fuel injection valve J.

In accordance with the conventional vapor separator provided with the high pressure fuel pump mentioned above, it is hard to continuously supply a stable and accurate fuel into the intake pipe K from the fuel injection valve J, and a good operation of the engine is impeded. That is, a wesco type pump is frequently used as the high pressure fuel pump PH since a discharge pulsation is a little and a compact and light structure can be achieved. The wesco type pump is structured, as shown in FIG. 3, such that an impeller PD driven by a motor M is rotatably arranged within a pump chamber PC, and when a rotational force is transmitted to the impeller PD due to a rotation of the motor M, a pressure difference is generated between the front and the rear of a vane groove formed on an outer periphery of the impeller PD on the basis of a liquid friction, the pressure of the fuel within the pump chamber PC is increased by the repetition of the above operation in a multiplicity of vane grooves, and the high pressure fuel having thus the increased pressure is discharged out via the fuel discharge passage PB. On the other hand, on the basis of a rotation of the impeller PD within the pump chamber PC, the fuel pressure within the pump chamber PC is reduced, whereby bubbles are generated, and the bubbles are discharged out of the pump chamber PC via a vapor discharge port PE pierced so as to open toward a bottom portion of a cover from the pump chamber PC. If the vapor stays within the pump chamber PC without being discharged, the bubbles gradually accumulate to become bigger, and a vapor lock is generated and the pump operation is impeded. Further, the bubbles containing the fuel discharged from the vapor discharge port PE is discharged into the second fuel storage 26, the upper opening of the second fuel storage 26 is sealed with a sealing 28 at this time, and the bubbles stay within the second fuel storage 26 because the second fuel storage 26 is in a closed state. Further, when a fixed amount of the bubbles stay, the bubbles are sucked into the pump chamber PC via the filter 27. In accordance with the structure mentioned above, the bubbles are contained in the fuel discharged from the high pressure fuel pump PH, and when the fuel containing the bubbles is injected from the fuel injection valve, an amount of injection from the fuel injection valve J is reduced in correspondence to the bubbles, so that it is impossible to supply an accurate fuel from the fuel injection valve J. Further, since the bubbles are contained in the fuel, the fuel supply is intermittently carried out, so that in any cases, an operability of the engine is deteriorated. Further, in the case that a large amount of bubbles stay within the pump chamber PC, there is a risk that the pump operation by the impeller can not be executed.

Further, paying attention to the vapor separator, a return fuel drops and flows into the vapor separator V via the return fuel passage 31 while the low pressure fuel drops and flows into the vapor separator V via the valve seat 21. Accordingly, since the bubbles are sucked into the fuel stored within the vapor separator V, the bubbles scatter in the fuel within the vapor separator V. Further, a part of the bubbles flow into the second fuel storage 26 via the communication passage 29. In accordance with the structure mentioned above, there is generated the same problem in the second fuel storage 26 as that generated by the bubbles discharged within the second fuel storage 26 from the vapor discharge port PE.

SUMMARY OF THE INVENTION

A vapor separator in an outboard machine in accordance with the present invention is made by taking the problems mentioned above into consideration, and an object of the present invention is to provide a vapor separator in an outboard machine in which a high pressure fuel pump is arranged in an outer portion of a vapor separator, wherein the high pressure fuel pump does not suck bubbles discharged from the high pressure fuel pump and bubbles generated within the vapor separator and it is possible to continuously supply a stable fuel from a fuel injection valve toward an engine, and another object thereof is to prevent a discharge performance of the high pressure fuel pump used in the vapor separator from being reduced.

In accordance with a first aspect of the present invention, in order to achieve the objects mentioned above, there is provided a vapor separator in an outboard machine in which a fuel within a fuel tank arranged at a position apart from an engine is supplied into a vapor separator by increasing a pressure by means of a low pressure fuel pump, and a pressure of the fuel within the vapor separator controlled to form a fixed liquid surface by a fixed liquid surface control mechanism is increased by a high pressure fuel pump so that the fuel is injected and supplied into an intake pipe connected to the engine via the fuel injection valve, characterized in that a filter is arranged in a bottom portion of a fuel pump receiving case, an upstream chamber of the filter is connected to a portion below the fixed liquid surface of the vapor separator via a fuel inflow passage, a fuel inflow passage of the high pressure fuel pump received and arranged within the fuel pump receiving case is connected to and arranged in a downstream chamber of the filter, a vapor discharge chamber separated from the downstream chamber of the filter and facing to a vapor discharge port of the high pressure fuel pump is provided in a bottom portion of the high pressure fuel pump within the fuel pump receiving case, the vapor discharge chamber is communicated with an annular chamber formed between an outer periphery of the high pressure fuel pump and an inner periphery of the fuel pump receiving case, and the annular chamber is communicated with a portion below and close to the fixed liquid surface of the vapor separator via the vapor discharge passage.

Further, in accordance with a second aspect of the present invention, in addition to the first aspect mentioned above, the vapor separator is characterized in that the upstream chamber of the filter is communicated with the vapor discharge chamber via a communication passage.

Further, in accordance with a third aspect of the present invention, in addition to the first aspect mentioned above, the vapor separator is characterized in that the filter is separated into a downstream chamber in which a fuel insertion port is open upward, a vapor discharge recess portion separated from the downstream chamber including the fuel insertion port and open upward and an upstream chamber recess portion open downward by a filtrating member arranged in a middle portion, and provided with a support leg portion open to the vapor discharge recess portion and supported to an outer periphery of the high pressure fuel pump so as to extend upward, the fuel suction passage of the high pressure fuel pump is inserted within the fuel insertion port, the vapor discharge chamber is formed by the bottom portion of the high pressure fuel pump and the vapor discharge recess portion, the support leg portion is brought into contact with and arranged on the outer periphery of the high pressure fuel pump, the upstream chamber of the filter is formed by the upstream chamber recess portion of the filter and the bottom portion of the fuel pump receiving case by the high pressure fuel pump provided with the filter being arranged toward the bottom portion of the fuel pump receiving case in a contact manner, an annular chamber connected to the vapor discharge chamber is formed by the outer periphery of the high pressure fuel pump and the inner periphery of the fuel pump receiving case, and the annular chamber is open to the portion below and close to the fixed liquid surface of the vapor separator by the vapor discharge passage.

In accordance with the first aspect, the high pressure fuel pump is arranged within the fuel pump receiving case arranged outside the vapor separator. The filter is arranged in the bottom portion within the fuel pump receiving case, the fuel suction passage of the high pressure fuel pump is connected to and arranged in the downstream chamber of the filter, and the upstream chamber of the filter is connected to the portion below the fixed liquid surface of the vapor separator via the fuel inflow passage. The vapor discharge chamber separated from the downstream chamber of the filter is formed within the fuel pump receiving case, the vapor discharge port of the high pressure fuel pump is open to the vapor discharge chamber, the annular chamber formed by the outer periphery of the high pressure fuel pump and the inner periphery of the fuel pump receiving case is communicated with the vapor discharge chamber, and the annular chamber is communicated with the portion below and close to the fixed liquid surface of the vapor separator via the vapor discharge passage. The fuel stored within the vapor separator flows toward the downstream chamber from the upstream chamber of the filter via the fuel inflow passage, a clean fuel within the downstream chamber is sucked into the pump via the fuel suction passage so as to increase the pressure thereof when the high pressure fuel pump is driven, and the fuel having the high pressure is discharged via the fuel discharge passage. The bubbles generated in the high pressure fuel pump is discharged into the vapor discharge chamber via the vapor discharge port, and the bubbles are discharged into the fuel below and close to the fixed liquid surface of the vapor separator via the annular chamber and the vapor discharge passage.

In accordance with the second aspect, since the upstream chamber of the filter and the vapor discharge chamber are communicated by the communication passage, even when the bubbles generated in the fuel of the vapor separator flow into the upstream chamber of the filter from the fuel inflow passage, the bubbles flow into the vapor discharge chamber from the communication passage and next is again discharged into the vapor separator via the annular chamber and a vapor discharge passage.

In accordance with the third aspect, the filter is structured such that the downstream chamber in which the fuel insertion port is open above the filtration member, and the vapor discharge recess portion separated from the fuel insertion port and the downstream chamber is formed, the upstream chamber recess portion is formed below the filtration member, and the support leg portion is supported to the outer periphery of the high pressure fuel pump and open to the vapor discharge recess portion. The fuel suction passage of the high pressure fuel pump is inserted and arranged within the fuel insertion port connected to the downstream chamber of the filter by inserting and arranging the bottom portion of the high pressure fuel pump toward the downstream chamber of the filter, the vapor discharge chamber is formed by the bottom portion of the high pressure fuel pump and the vapor discharge recess portion, and the vapor discharge port of the high pressure fuel pump is open within the vapor discharge chamber. The high pressure fuel pump provided with the filter is received and arranged toward the bottom portion of the fuel pump receiving case, whereby the filter upstream chamber connected to the fuel inflow passage is formed by the upstream chamber recess portion of the filter and the bottom portion of the fuel pump receiving case, and the vapor discharge chamber is communicated with the annular chamber formed on the outer periphery of the high pressure fuel pump.

DESCRIPTION OF THE PREFERRED EMBODIMENT

Figure 1:
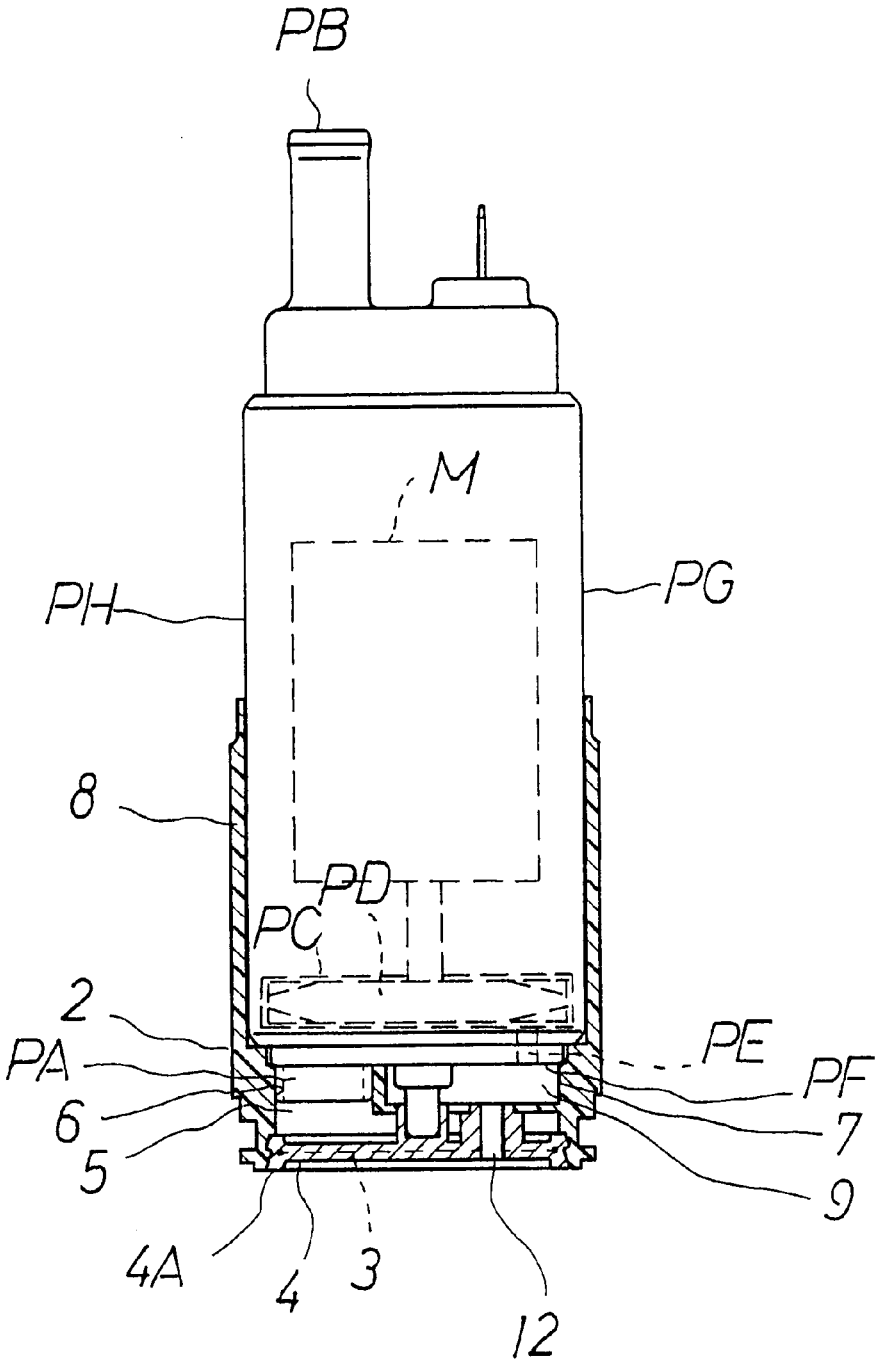
FIG. 1 is a vertical cross sectional view of a main portion showing an embodiment of a vapor separator in an outboard machine in accordance with the present invention, and showing a state in which a filter is attached to a high pressure fuel pump.

A description will be given below of an embodiment of a vapor separator in an outboard machine in accordance with the present invention with reference to FIG. 1. A vapor separator V is constituted by a lower casing VA formed in a closed-end cup shape, and a cover VB closing an upper opening thereof, and a fixed liquid surface X-X is formed and held within the vapor separator V by the same fixed liquid surface control mechanism F as the conventional one. The fixed liquid surface control mechanism F and a low pressure fuel flow passage 20 are omitted. Reference numeral 1 denotes a fuel pump receiving case formed and arranged separately from the vapor separator V. The fuel pump receiving case 1 is formed in a closed-end cup shape having a bottom portion 1A, and an upper opening thereof is closed by a cover 1B. The fuel pump receiving case 1 is screwed with a side portion of the vapor separator V by means of a fastening member (not shown) such as a screw, a bolt or the like, and a fuel inflow passage 1C open to the bottom portion 1A of the fuel pump receiving case 1 is open to a lower position of the fixed liquid surface X-X of the vapor separator V via a joint pipe 1D so as to be communicated within the vapor separator V. Further, an inner periphery 1E of the fuel pump receiving case 1 and an inner portion of the vapor separator V are communicated with each other by a vapor discharge passage 1P, and the vapor discharge passage 1P is open to a portion close to the fixed liquid surface X-X of the vapor separator V and below the fixed liquid surface X-X. The high pressure fuel pump PH is the same as the conventional one, a fuel suction passage PA connected to the pump chamber PC protrudes and opens downward and a vapor discharge port PE opens in a bottom portion PF thereof, and a fuel discharge passage PB protrudes and opens in an upper portion thereof.

Reference numeral 2 denotes a filter. The filter 2 is constituted of the following elements. The filter 2 is separated into the upstream side and the downstream side by a mesh-like filtrating member 3 arranged in a middle portion thereof. (In this case, the upstream and the downstream are referred in view of a fuel flow direction.) An upstream chamber recess portion 4 is recessed downward in the upstream side of the filtration member 3, and a lower end portion 4A of the upstream chamber recess portion 4 is formed in an annular flat shape. Further, a downstream chamber 5 of a sealed filter is formed in the downstream side of the filtration member 3, and a fuel insertion port 6 for inserting and supporting the fuel suction passage PA of the high pressure fuel pump PH is formed in the downstream chamber 5 of the filter. That is, only the fuel insertion port 6 is open to the downstream chamber 5 of the filter. Further, a vapor discharge recess portion 7 open upward is recessed in an outer side portion of the downstream chamber 5 of the filter, and the vapor discharge recess portion 7 is separated from the downstream chamber 5 of the filter. Further, a plurality of support leg portions 8 are stood upward from the outer side portion of the downstream chamber 5 of the filter and the outer side portion of the vapor discharge recess portion 7, and the support leg portions 8 are brought into contact with and arranged in a cylindrical outer periphery PG of the high pressure fuel pump PH with an elasticity. A plurality of the support leg portions 8 are arranged in a circumferential direction of a horizontal cross section with a gap S, and the gap S is connected and opens to the vapor discharge recess portion 7. That is, the gap S reaches the vapor discharge recess portion 7. In this case, it is preferable that the filter 2 is formed by a synthetic resin material.

Next, a description will be given of an assembly thereof. At first, the filter 2 is attached toward the bottom portion PF of the high pressure fuel pump PH. Accordingly, the fuel suction passage PA of the high pressure fuel pump PH is inserted and arranged within the fuel insertion port 6 of the filter 2. Further, the vapor discharge recess portion 7 is arranged so as to face to the bottom portion PF of the high pressure fuel pump PH, whereby the vapor discharge chamber 9 is formed by the bottom portion PF and the vapor discharge recess portion 7. The vapor discharge chamber 9 is formed so as to be separated from the downstream chamber 5 of the filter, and the vapor discharge port PE of the high pressure fuel pump PH is open within the vapor discharge chamber 9. On the other hand, a plurality of the support leg portions 8 are attached and supported to the outer periphery PG of the high pressure fuel pump PH with the elastic force, whereby the filter 2 can be attached to the high pressure fuel pump PH without dropping out. In this case, the gap S formed between a plurality of the support leg portions 8 is open to the vapor discharge chamber 9 formed in the manner mentioned above. FIG. 1 shows a state in which the filter 2 is attached to the high pressure fuel pump PH as mentioned above.

The high pressure fuel pump PH provided with the filter 2 mentioned above is arranged within the fuel pump receiving case 1. The high pressure fuel pump PH provided with the filter 2 is arranged by being inserted toward the bottom portion 1A of the fuel pump receiving case 1 from the upper opening of the fuel pump receiving case 1. In accordance with the structure mentioned above, the lower end portion 4A of the upstream chamber recess portion 4 in the filter 2 is brought into contact with and arranged in the bottom portion 1A, and an upstream chamber 10 of the filter is formed by the bottom portion 1A of the fuel pump receiving case 1 and the upstream chamber recess portion 4 of the filter 2. Further, the downstream end of a fuel inflow passage 1C formed below the fuel pump receiving case 1 is open to the upstream chamber 10 of the filter. On the other hand, an annular chamber 11 is formed by the outer periphery PG of the high pressure fuel pump PH and the inner periphery 1E of the fuel pump receiving case 1, and the support leg portions 8 are arranged within the annular chamber 11.

Next, the upper opening of the fuel pump receiving case 1 is closed by the cover 1B, and then, the fuel discharge passage PB of the high pressure fuel pump PH is connected to the high pressure fuel flow passage 30 provided in the cover 1B.

Figure 2:
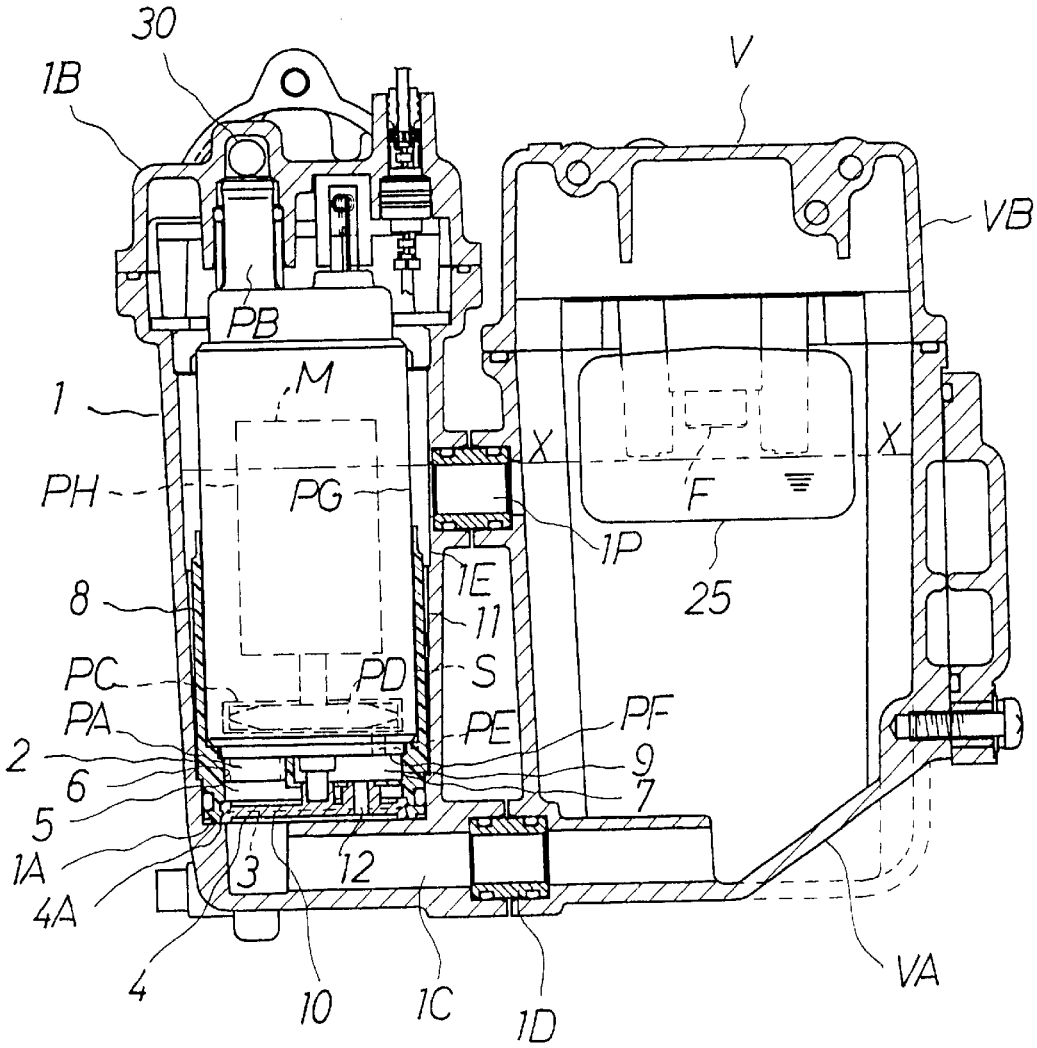
FIG. 2 is a vertical cross sectional view of a main portion showing a state in which the high pressure fuel pump is attached to a vapor separator.
Figure 3:
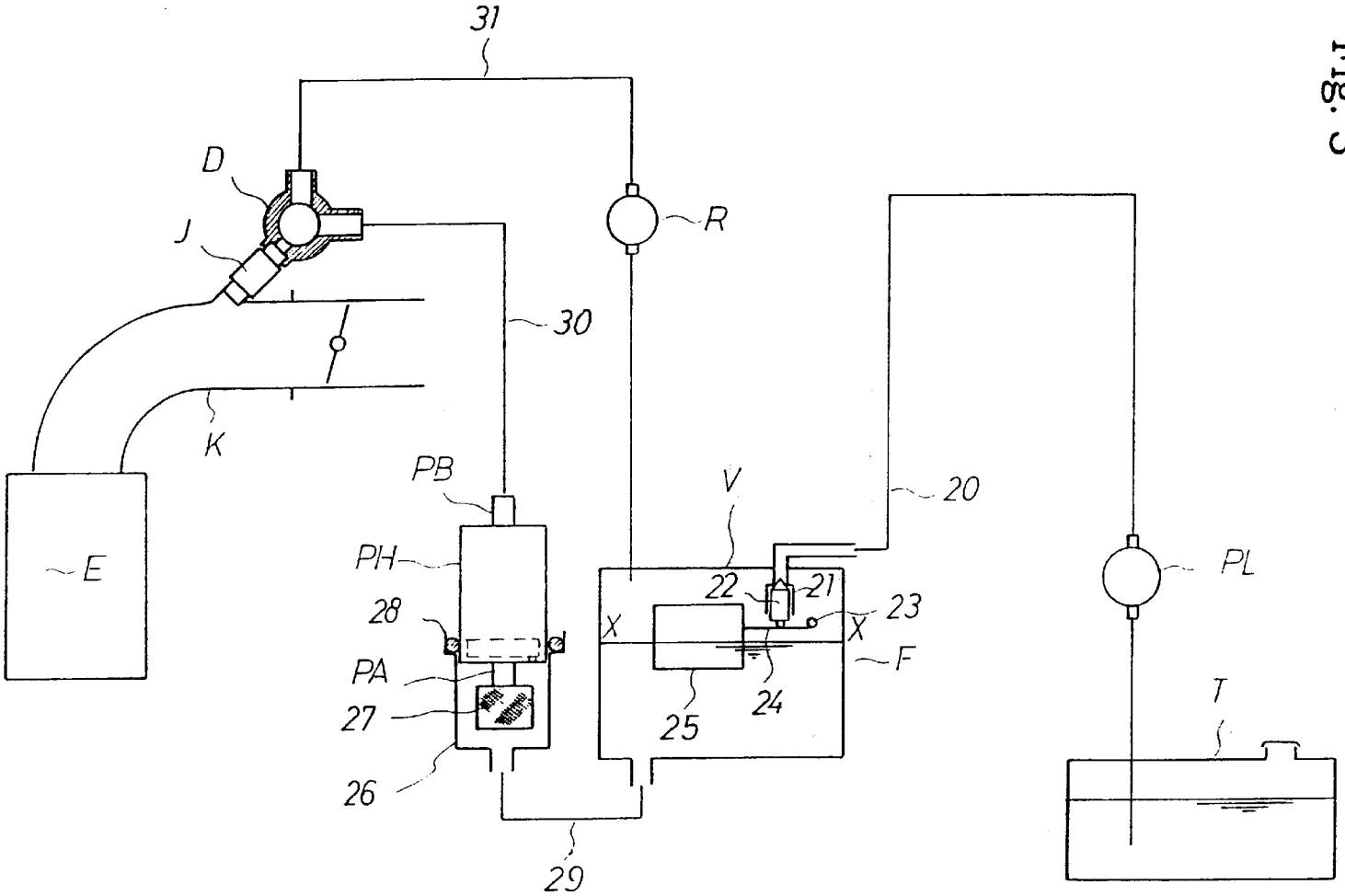
FIG. 3 is a schematic view of a system showing a fuel injection system in a conventional outboard machine.
Figure 4:
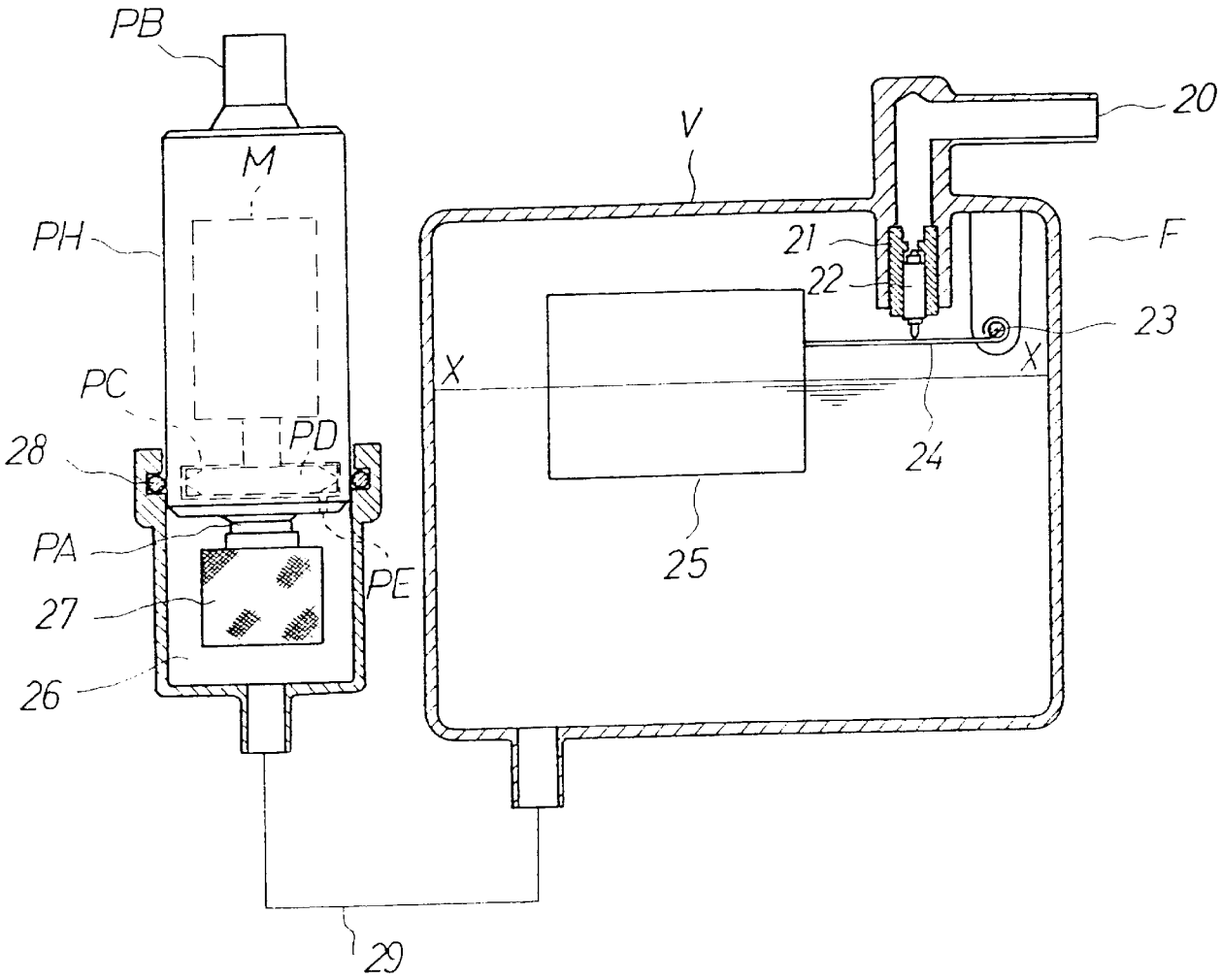
FIG. 4 is a schematic view of a separator provided with a conventional high pressure fuel pump.

In accordance with the structure mentioned above, an assembly of the high pressure fuel pump PH provided with the filter 2 with the fuel pump receiving case 1 is completed as shown in FIG. 2, and in accordance with the structure mentioned above, the upstream chamber 10 of the filter is communicated with the portion below the fixed liquid surface X-X of the vapor separator V via the fuel inflow passage 1C, and the fuel suction passage PA of the high pressure fuel pump PH is connected and open to the inner portion of the downstream chamber 5 of the filter. On the other hand, the vapor discharge port PE of the high pressure fuel pump PH is open within the vapor discharge chamber 9, the vapor discharge chamber 9 is communicated within the annular chamber 11 via the gap S, and the annular chamber 11 is communicated with the portion below and close to the fixed liquid surface X-X within the vapor separator V via the vapor discharge passage 1P.

Next, a description will be given of an operation thereof. When the motor of the high pressure fuel pump PH is driven, whereby a pumping operation is started, the fuel within the fuel separator V flows into the downstream chamber 5 of the filter via the fuel inflow passage 1C, the upstream chamber 10 of the filter and the filtration member 3, the clean fuel from which foreign matters are removed by the filtration member 3 is sucked into the high pressure fuel pump PH via the fuel suction passage PA open within the downstream chamber 5 of the filter, whereby the pressure thereof is increased, and next, the fuel having the increased pressure is discharged toward the high pressure fuel flow passage 30 from the fuel discharge passage PB. In accordance with the structure mentioned above, when the high pressure fuel pump PH is driven, the bubbles generated within the pump chamber PC are discharged into the vapor discharge chamber 9 via the vapor discharge hole PE together with a part of the fuel the pressure of which is increased within the pump chamber PC, and the bubbles flows into the annular chamber 11 via the gap S together with the fuel, ascend within the annular chamber 11 due to their own buoyancy, and are discharged into the portion below the fixed liquid surface X-X of the vapor separator V via the vapor discharge passage 1P disposed at an upper position. In accordance with the structure mentioned above, since the bubbles discharged from the vapor discharge port PE are discharged into the vapor separator V at a position apart from the high pressure fuel pump PH, the bubbles mentioned above are not again sucked from the fuel suction passage PA of the high pressure fuel pump PH, and the fuel containing the bubbles are not discharged from the high pressure fuel pump PH toward the high pressure fuel flow passage 30.

Further, since the vapor discharge passage 1P is open to the portion below and close to the fixed liquid surface X-X within the vapor separator V, a bubbling is not generated within the vapor separator V by the fuel containing the bubbles discharged from the vapor discharge passage 1P, and it is possible to effectively execute a cooling operation of the high pressure fuel pump PH by the fuel. That is, the opening of the vapor discharge passage 1P into the vapor separator V is set to an upper position from the fixed liquid surface X-X, the bubbling is generated on the liquid surface by the fuel containing the bubbles discharged from the high position, and there is a risk that the bubbles are again sucked into the high pressure fuel pump PH via the fuel inflow passage 1C. On the other hand, in the case that the opening of the vapor discharge passage 1P is set to the position below the fixed liquid surface X-X, a big sealed space exists in an upper portion of the annular chamber 11, so that there is a risk that the fuel stays in the upper portion of the annular chamber 11 without circulating, whereby it is impossible to expect the fuel cooling effect of the high pressure fuel pump PH.

Further, in the case that a communication passage 12 for communicating the upstream chamber 10 of the filter with the vapor discharge chamber 9 is provided in the filter 2, even when the bubbles flow into the upstream chamber 10 of the filter from the vapor separator V via the fuel inflow passage 1C, the bubbles flow into the vapor discharge chamber 9 disposed at the upper position via the communication passage 12 due to their own buoyancy, whereby it is possible to prevent the high pressure fuel pump PH from sucking the bubbles flowing into the upstream chamber 10 of the filter and existing therein.

As mentioned above, in accordance with the vapor separator in the outboard machine of the present invention, since the filter is arranged in the bottom portion of the fuel pump receiving case, the upstream chamber of the filter is connected to the portion below the fixed liquid surface of the vapor separator via the fuel inflow passage, the fuel inflow passage of the high pressure fuel pump received and arranged within the fuel pump receiving case is connected to and arranged in the downstream chamber of the filter, the vapor discharge chamber separated from the downstream chamber of the filter and facing to the vapor discharge port of the high pressure fuel pump is provided in the bottom portion of the high pressure fuel pump within the fuel pump receiving case, the vapor discharge chamber is communicated with the annular chamber formed between the outer periphery of the high pressure fuel pump and the inner periphery of the fuel pump receiving case, and the annular chamber is communicated with the portion below and close to the fixed liquid surface of the vapor separator via the vapor discharge passage, the bubbles are not mixed in the fuel discharged from the high pressure fuel pump, whereby it is possible to continuously supply a stable accurate fuel from the fuel injection valve, thereby an operability of the engine being largely improved. Further, it is possible to prevent the bubbles from entering into the pump chamber of the high pressure fuel pump, whereby it is possible to improve a pump efficiency. Further, since the high pressure fuel pump is effectively cooled by the fuel flowing within the annular chamber, it is possible to restrict a reduction of the pump efficiency caused by the temperature increase of the high pressure fuel pump.

Further, in the case that the upstream chamber of the filter is communicated with the vapor discharge chamber via the communication passage, it is possible to discharge the bubbles flowing into the upstream chamber of the filter via the vapor discharge chamber, thereby preventing the bubbles from entering into the high pressure fuel pump, so that it is possible to solve the problems caused by the bubbles in the same manner as mentioned above.

What is claimed is:

1. A vapor separator in an outboard machine in which a fuel within a fuel tank arranged at a position apart from an engine is supplied into a vapor separator by increasing a pressure by means of a low pressure fuel pump, and a pressure of the fuel within the vapor separator controlled to form a fixed liquid surface by a fixed liquid surface control mechanism is increased by a high pressure fuel pump so that the fuel is injected and supplied into an intake pipe connected to the engine via the fuel injection valve, characterized in that a filter (2) is arranged in a bottom portion (1A) of a fuel pump receiving case (1), an upstream chamber (10) of the filter (2) is connected to a portion below the fixed liquid surface of the vapor separator (V) via a fuel inflow passage (1C), a fuel inflow passage (PA) of the high pressure fuel pump (PH) received and arranged within the fuel pump receiving case (1) is connected to and arranged in a downstream chamber (5) of the filter, a vapor discharge chamber (9) separated from the downstream chamber (5) of the filter and facing to a vapor discharge port (PE) of the high pressure fuel pump (PH) is provided in a bottom portion (PF) of the high pressure fuel pump (PH) within the fuel pump receiving case (1), the vapor discharge chamber is communicated with an annular chamber (11) formed between an outer periphery (PG) of the high pressure fuel pump (PH) and an inner periphery (1E) of the fuel pump receiving case (1), and the annular chamber (11) is communicated with a portion below and close to the fixed liquid surface (X-X) of the vapor separator (V) via a vapor discharge passage (1P).

2. A vapor separator in an outboard machine as claimed in claim 1, characterized in that the upstream chamber (10) of the filter is communicated with the vapor discharge chamber (9) via a communication passage (12).

3. A vapor separator in an outboard machine as claimed in claim 1, characterized in that the filter is separated into a downstream chamber (5) in which a fuel insertion port (6) is open upward, a vapor discharge recess portion (7) separated from the downstream chamber (5) including the fuel insertion port (6) and open upward and an upstream chamber recess portion (4) open downward by a filtrating member (3) arranged in a middle portion, and provided with a support leg portion (8) open to the vapor discharge recess portion (7) and supported to an outer periphery of the high pressure fuel pump (PH) so as to extend upward, the fuel suction passage (PA) of the high pressure fuel pump (PH) is inserted within the fuel insertion port, the vapor discharge chamber (9) is formed by the bottom portion (PF) of the high pressure fuel pump (PH) and the vapor discharge recess portion (7), the support leg portion (8) is brought into contact with and arranged on the outer periphery (PG) of the high pressure fuel pump (PH), the upstream chamber (10) of the filter is formed by the upstream chamber recess portion (4) of the filter (2) and the bottom portion (1A) of the fuel pump receiving case (1) by the high pressure fuel pump (PH) provided with the filter being arranged toward the bottom portion (1A) of the fuel pump receiving case (1) in a contact manner, an annular chamber (11) connected to the vapor discharge chamber (9) is formed by the outer periphery (PG) of the high pressure fuel pump (PH) and the inner periphery (1E) of the fuel pump receiving case (1), and the annular chamber is open to the portion below and close to the fixed liquid surface (X-X) of the vapor separator (V) by the vapor discharge passage (1P).

* * * * *